US005573232A

United States Patent [19]

Ifkovits et al.

[11] Patent Number: 5,573,232

[45] Date of Patent: Nov. 12, 1996

[54] PARALLEL SHEET PROCESSING APPARATUS

[76] Inventors: Edward M. Ifkovits, 2 Schermerhorn Dr., New Fairfield, Conn. 06812; Karel J. Janatka, 32A Heritage Cir., Southbury, Conn. 06488; Joseph F. Zuzick, Jr., 108-3 Lantern Park Dr., Naugatuck, Conn. 06770

[21] Appl. No.: 489,097

[22] Filed: Jun. 9, 1995

[51] Int. Cl.[6] ..... B42C 1/10

[52] U.S. Cl. ..... 270/51; 270/52.12

[58] Field of Search ..... 270/32, 39.01, 270/45, 51, 52.09, 52.12, 58.01, 58.06

[56] References Cited

U.S. PATENT DOCUMENTS

| | | | |
|---|---|---|---|
| 3,441,267 | 4/1969 | Carstens | 270/45 |
| 4,034,973 | 7/1977 | Hams | 270/52.09 X |
| 4,527,791 | 7/1985 | Piotroski | 270/52.09 |
| 4,707,790 | 11/1987 | Gomes et al. | 270/58.06 X |
| 4,795,143 | 1/1989 | Tsai | 270/58.01 X |
| 5,143,362 | 9/1992 | Doane et al. | 270/45 X |
| 5,435,534 | 7/1995 | Linkowski et al. | 270/51 |

*Primary Examiner*—John E. Ryznic
*Attorney, Agent, or Firm*—Lawrence E. Sklar; Melvin J. Scolnick

[57] ABSTRACT

Apparatus for folding paper sheets of different length or into different folding patterns and for combining the folded sheets into a single collation. The apparatus includes: a first, right angle paper path for folding paper sheets s of a given size; and a second, straight paper path for folding paper sheets either of a different size than the paper sheets in the first path or in a different folding pattern than the paper sheets in the first path.

The first, right angle paper path includes a first accumulator for receiving a first plurality of paper sheets and aligning the first plurality of paper sheets into a first collation, a first folder downstream of the first accumulator for folding the first collation, a right angle transfer for receiving the first, folded collation and for feeding the first, folded collation out of the transfer in a direction perpendicular from the direction of entry of the first, folded collation into the transfer without changing the orientation of the first, folded collation, and a drop feeder downstream of the right angle transfer for dropping the first, folded collation onto the second, straight paper path.

The second, straight paper path intersects with the drop feeder of the first, right angle paper path, and the second, straight paper path includes a second accumulator for receiving a second plurality of paper sheets and aligning the second plurality of paper sheets into a second collation, a second folder downstream of the second accumulator for folding the second collation differently than the first collation, a device for receiving the second, folded collation and the first, folded collation at a registration location, and a device for conveying the combined first and second, folded collations downstream from the receiving device.

7 Claims, 2 Drawing Sheets

12
14
16
18
20
22
24
26
30
32
34
36
38
40
48
52
2
3
10
62
64
66
27
29
31
33
35
44
46
50
54
56
60

PARALLEL SHEET PROCESSING APPARATUS

BACKGROUND OF THE INVENTION

The instant invention relates to an inserting system for inserting folded documents into an envelopc, and more particularly to such a system for folding documents of different lengths.

Inserting systems are well known in the art and are generally used by business organizations which make large mailings where the contents of each item mailed may vary. Such systems typically comprise: feeder modules for feeding individual or multiple sheets into a batch; web modules for separating webs into discrete sheets and feeding the discrete sheets into the batch; a transport system for conveying sheets and forms through the various modules to form proper batches; folding modules for folding individual sheets or batches of sheets; inserter modules for inserting the batches into envelopes, which are preferably preaddressed; optionally, meter modules for metering the envelopes with appropriate postage; and a control system to synchronize the operation of the inserter system to assure that the batches are properly assembled, inserted into envelopes, and, possibly, metered with appropriate postage.

In typical inserting applications, the individual sheet or batches of sheets to be folded are of the same length so that only one folding machine is required. There are applications which utilize a plurality of parallel folding systems for webs which have been burst into discrete sheets. Such a system is disclosed in U.S. Pat. No. 4,707,790 issued Nov. 17, 1987 to the assignee of the instant invention. In the '790 patent, four webs of computer print-out forms, parallel to each other, are burst into discrete forms, accumulated, fed onto a transport unit and then merged into a batch for insertion into an envelope. Each of the webs is identical, and the web-handling apparatus is identical.

There is a need for apparatus which can process and fold discrete sheets of different length or fold identical length sheets in different folding patterns. In such cases, more than one folder is required because one folder cannot be set to fold to more than one length or one format. There is no prior art which teaches apparatus which answers the foregoing need. Accordingly, the instant invention provides apparatus for folding sheets of different lengths or sheets of the same length into different folding patterns and then combining the folded sheets into a single collation for insertion into an envelope.

SUMMARY OF THE INVENTION

Thus, the instant invention provides apparatus for folding paper sheets of different length or into different folding patterns and for combining the folded sheets into a single collation. The apparatus comprises: a first right angle paper path for folding paper sheets of a given size; and a second, straight lo paper path for folding paper sheets either of a different size than said paper sheets in said first path or in a different folding pattern than said paper sheets in said first path.

The first, right angle paper path includes a first accumulator for receiving a first plurality of paper sheets and aligning said first plurality of paper sheets into a first collation, a first folder downstream of said first accumulator for folding said first collation, a right angle transfer for receiving said first, folded collation and for feeding said first, folded collation out of said transfer in a direction perpendicular from the direction of entry of said first, folded collation into said transfer without changing the orientation of said first, folded collation, and a drop feeder downstream of said right angle transfer for dropping said first, folded collation onto said second, straight paper path.

The second, straight paper path intersects with the drop feeder of the first, right angle paper path, and said second, straight paper path includes a second accumulator for receiving a second plurality of paper sheets and aligning said second plurality of paper sheets into a second collation, a second folder downstream of said second accumulator for folding said second collation differently than said first collation, means for receiving said second, folded collation and said first, folded collation at a registration location, and means for conveying said combined first and second, folded collations downstream from said receiving means.

DETAILED DESCRIPTION OF THE PREFERRED EMBODIMENT

Figures 1, 2, 3, 4:
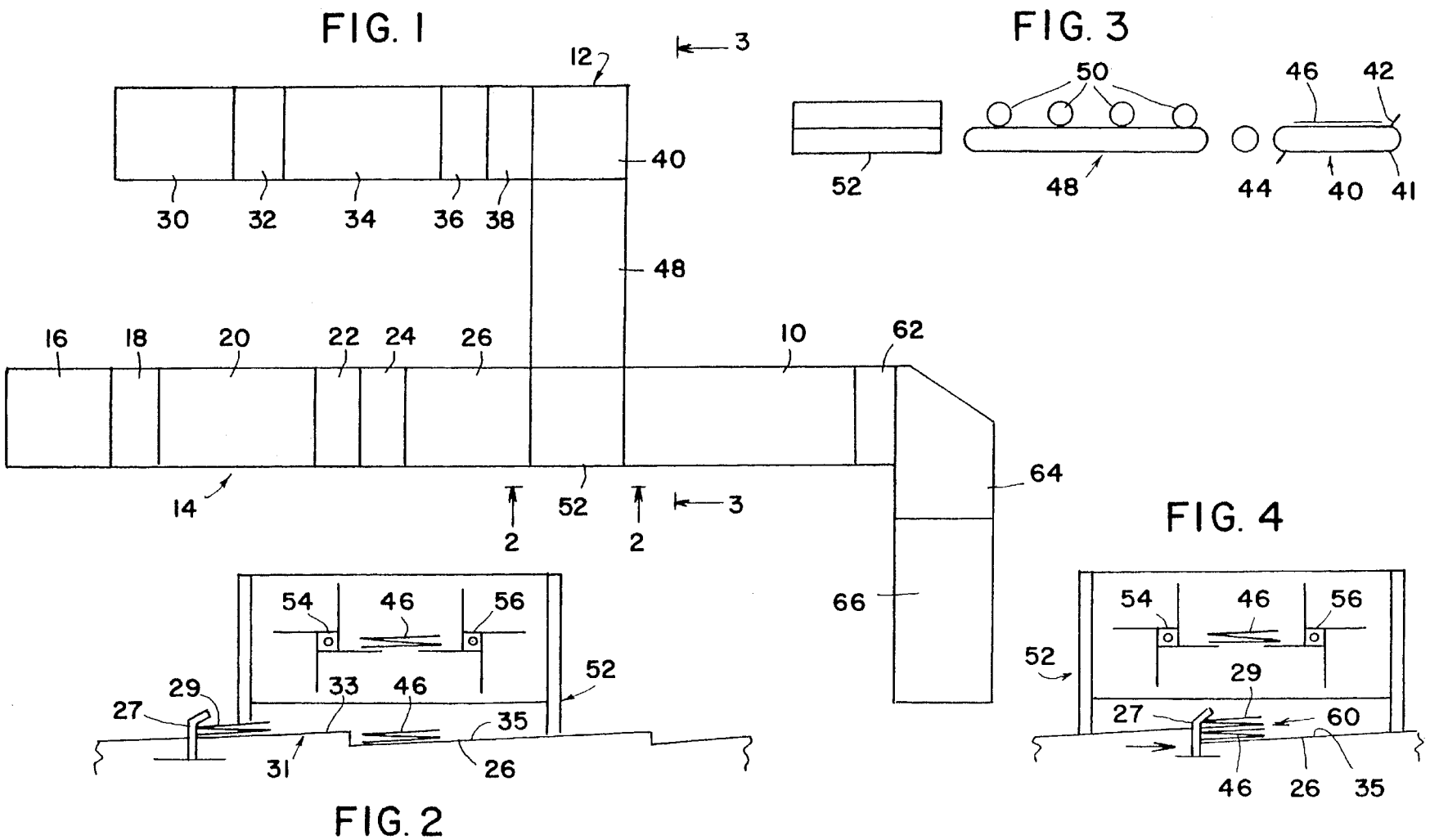
FIG. 1 is a schematic, top, plan view of an inserting system for folding sheets of two different lengths or two sheets of the same length into different folding patterns, in accordance with the instant invention.
FIG. 2 is a schematic, side elevational view taken on the plane indicated by the line 2—2 in FIG. 1.
FIG. 3 is a schematic, front, elevational view taken on the plane indicated by the line 3—3 in FIG. 1, and the three lines 3—3 in FIG. 5.
FIG. 4 is similar to FIG. 3 but shows two folded collations having been combined.

In describing the preferred embodiment of the instant invention, reference is made to the drawings, wherein there is seen in FIG. 1 a layout for processing sheets of paper to be folded and inserted into an inserter 10. Sheets of paper formed from a continuous web of paper are processed in a right angle path generally designated 12 and cut paper sheets are processed along a straight path generally designated 14..

With respect to the straight path 14 an imprinted web of paper is fed from upstream apparatus (not shown) to a single web paper cutter 16 which cuts the web (not shown)into discrete sheets of paper. The discrete sheets of paper exit the cutter 16 and are conveyed to a feeder interface module 18 and then to an accumulator 20 where the cut sheets are aligned and registered. The accumulator 20 then feeds the registered collation of cut sheets to a conventional, buckle chute folder 22 which can impart the desired fold to the collation of cut sheets. The folder 22 can be set to handle whatever the size of the cut paper sheets and to fold the sheets in half or thirds, or whatever format is desired for the paper being run. The folded collation of cut sheets is then fed from the folder 22 to a folder elevator module 24 in order to be fed to a transport 26 having a plurality of pusher fingers 27 (see FIG. 2; only one pusher finger 27 is shown) for urging folded, cut sheets 29 onto the leap frog deck ramp 31 of a drop feeder 52. The deck ramp 31 includes a first ramp 33 and a second ramp 35.

With respect to the right angle path 12, a web of paper (not shown) having traverse scored or weakened lines and marginal, traction areas defined by longitudinal weakened lines is fed to a web burster 30. The marginal areas have punched holes for engagement with a pin type feeding device, e.g. sprockets. The burster 30 breaks apart the scored webs into discrete sheets and conveys the discrete sheets to a feeder interface module 32 which then conveys the discrete sheets to an accumulator 34 where the discrete sheets are aligned and registered as a collation. The collated discrete sheets are then fed from the accumulator 34 to a buckle chute folder 36 which imparts the desired fold to the collation of discrete, bursted sheets. The folder, bursted sheets exit the folder 36 and are fed to a folder elevator module 38 from which the sheets are fed to a right angle transfer 40 which utilizes a pair of belts 41 and a pair of pusher fingers 42 and 44 (see FIG. 3) to push the folded, bursted sheets 46 in a direction perpendicular to the direction of travel of the sheets 46 into the right angle transfer 40.

The folded sheets 46 are pushed by the right angle transfer 40 onto a conveyor 48 employing a plurality of rollers 50 (see FIG. 3). The folded sheets 46 are then fed from the conveyor 48 onto the drop feeder 52 which utilizes a pair of indexing stars 54 and 56 to collect and then dump the folded sheets 46 onto the second ramp 35 of the leap frog deck ramp 31. The timing of the two collations 46 and 29 is such that the bursted sheets 46 are first dumped onto the second ramp 35 as seen in FIG. 2 and then the pusher fingers 27 urge the cut sheets 29 along the first ramp 31 and over the burst sheets 46 resting on the second ramp 35, as seen in FIG. 4. There then exists a combined collation 60 consisting of the two collations 29 and 46, with the collation 29 resting on top of the collation 46. The combined collation 60 is then conveyed to the inserting machine 10. Envelopes (not shown) are conveyed from an envelope feeding machine 62 to the inserter 10 which inserts the combined collation 60 into the waiting envelopes, in conventional fashion. The filled envelopes are then conveyed by a right angle transfer 64 to a mailing machine 66 which seals the envelope and applies the appropriate amount of postage to the envelope. It should be noted that although the combined collation 60 is shown as having the collation 29 on top, that it can be reversed and the collation 29 can be on the bottom with the collation 46 on top. To achieve this result, it is merely a matter of having the collation 29 first dumped onto the second ramp 35 and then dropping the collation 46 on top of the collation 29.

From the foregoing description, it can be seen that the size of the sheets in the two collations 29 and 46 can be different, and that they can be folded differently, and then they can be combined to form the single collation 60. It can also be seen that their orientation is not changed, and specifically that the burster sheets 46 are never rotated in the course of travel from the burster 30 to the drop feeder 52. Although the foregoing description relates to combining two collations from two separate paths, it is possible to arrange the modules so that three or more different size sheets can be folded and later combined into a single collation.

Figure 5:
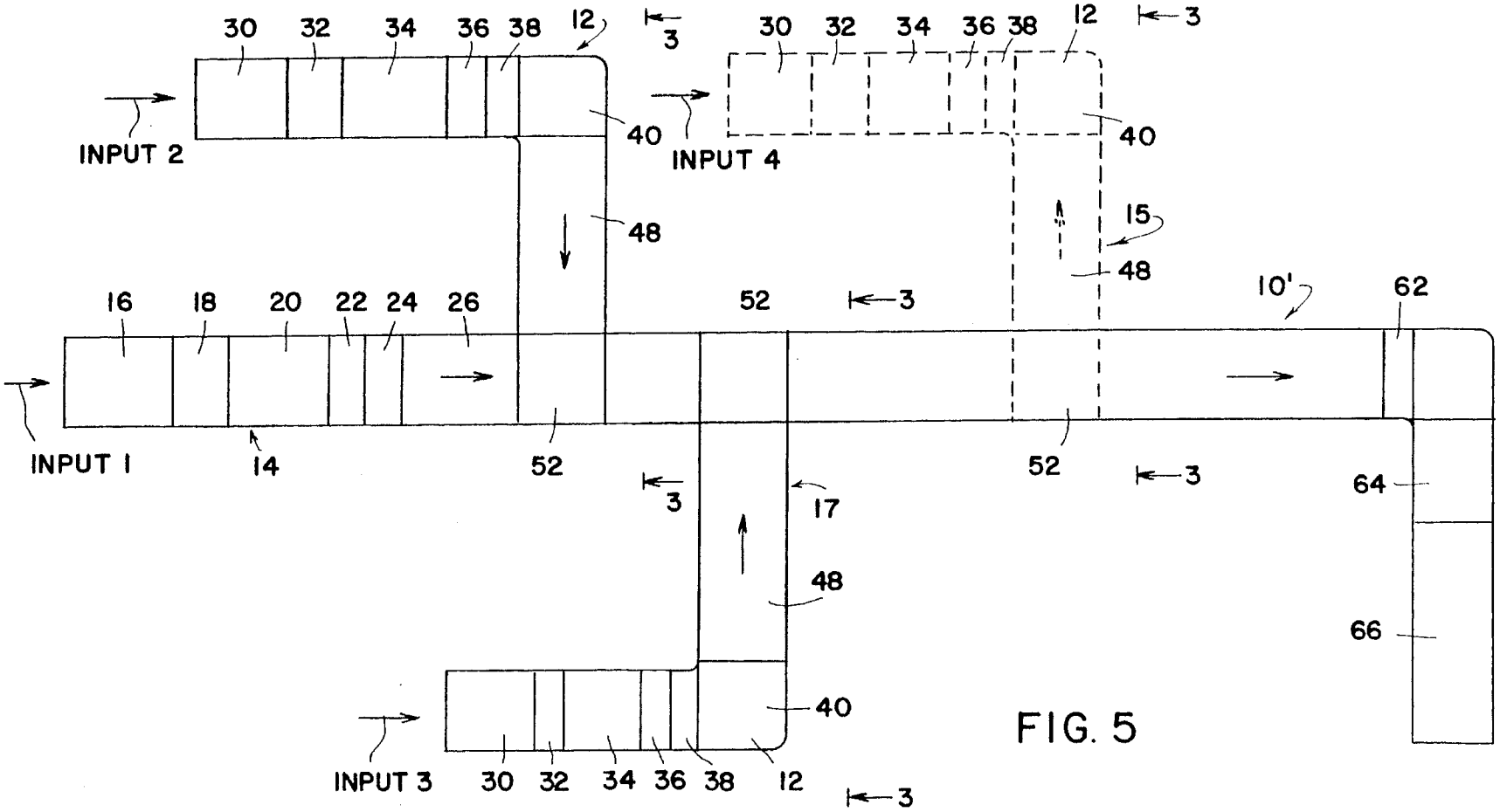
FIG. 5 is similar to FIG. 1 but shows a layout for folding four different size sheets or four different folding patterns.

Referring now to FIG. 5, there is seen a layout for folding four different size sheets, or folding four of the same size sheets in four different folding patterns, or any combination of four variations of folding. The layout includes, as in the case of FIG. 1, a right angle path 12 and a straight path 14, as well as a second right angle path 15 and a third right angle path 17. The inserting apparatus 10' extends from the drop feeder 52 in the path 14 to the envelope feeder 62. The inserting apparatus 10' includes the necessary and appropriate feeders, which are not shown but are well known in the art.

It should be noted that the foregoing apparatus can be used to process equal sized sheets that are to be folded in the same or different folding patterns but which emanate from more than one web and are part of a single collation.

It should be understood by those skilled in the art that various modifications may be made in the present invention without departing from the spirit and scope thereof, as described in the specification and defined in the appended claims.

What is claimed is:

1. Apparatus for folding paper sheets of the same length emanating from more than one web and for combining the folded sheets into a single collation, comprising:

a first, right angle paper path for folding paper sheets from a first web of paper; and a second, straight paper path for folding paper sheets from a second web of paper, wherein A. said first, right angle paper path includes a first accumulator for receiving a first plurality of paper sheets and aligning said first plurality of paper sheets into a first collation, a first folder downstream of said first accumulator for folding said first collation, a right angle transfer for receiving said first, folded collation and for feeding said first, folded collation out of said transfer in a direction perpendicular from the direction of entry of said first, folded collation into said transfer without changing the orientation of said first, folded collation, and a drop feeder downstream of said right angle transfer for dropping said first, folded collation onto said second, straight paper path, and B. said second, straight paper path intersects with the drop feeder of the first, right angle paper path, and said second, straight paper path includes a second accumulator for receiving a second plurality of paper sheets and aligning said second plurality of paper sheets into a second collation, a second folder downstream of said second accumulator for folding said second collation differently than said first collation, means for receiving said second, folded collation and said first, folded collation at a registration location, and means for conveying said combined first and second, folded collations downstream from said receiving means.

2. Apparatus for folding paper sheets of different length or into different folding patterns and for combining the folded sheets into a single collation, comprising:

a first, right angle paper path for folding paper sheets of a given size; and a second, straight paper path for folding paper sheets either of a different size than said paper sheets in said first path or in a different folding pattern than said paper sheets in said first path, wherein A. said first, right angle paper path includes a first accumulator for receiving a first plurality of paper sheets and aligning said first plurality of paper sheets into a first collation, a first folder downstream of said first accumulator for folding said first collation, a right angle transfer for receiving said first, folded collation and for feeding said first, folded collation out of said transfer in a direction perpendicular from the direction of entry of said first, folded collation into said transfer without changing the orientation of said first, folded collation, and a drop feeder downstream of said right angle transfer for dropping said first, folded collation onto said second, straight paper path, and B. said second, straight paper path intersects with the drop feeder of the first, right angle paper path, and said second, straight paper path includes a second accumulator for receiving a second plurality of paper sheets and aligning said second plurality of paper sheets into a second collation, a second folder downstream of said second accumulator for folding said second collation differently than said first collation, means for receiving said second, folded collation and said first, folded collation at a registration location, and means for conveying said combined first and second, folded collations downstream from said receiving means.

3. The apparatus of claim 2, wherein said first and second folders comprise buckle chute folders.

4. The apparatus of claim 2, wherein said right angle transfer includes pusher fingers for feeding said first, folded collation in said perpendicular direction.

5. The apparatus of claim 4, wherein said receiving means comprises a leap frog deck ramp.

6. The apparatus of claim 5, wherein said leap frog deck ramp includes a first ramp for receiving the second, folded collation and a second ramp for receiving the first, folded collation and the second folded collation from the first ramp.

7. The apparatus of claim 2, comprising a third, right angle paper path for folding paper sheets either of a different size than said paper sheets in said first and second paths or in a different folding pattern than said paper sheets in said first and second paths.

* * * * *

UNITED STATES PATENT AND TRADEMARK OFFICE

CERTIFICATE OF CORRECTION

PATENT NO. : 5,573,232
DATED : November 12, 1996
INVENTOR(S) : Edward M. Ifkovits, et al.

It is certified that error appears in the above-indentified patent and that said Letters Patent is hereby corrected as shown below:

Cover Page: Add item [73] Assignee: Pitney Bowes Inc.
Stamford, Connecticut

Signed and Sealed this

Nineteenth Day of August, 1997

*Attest:*

Bruce Lehman

BRUCE LEHMAN

*Attesting Officer*

*Commissioner of Patents and Trademarks*